United States Patent [19]

Spaller, Jr. et al.

[11] Patent Number: 4,917,660

[45] Date of Patent: Apr. 17, 1990

[54] APPARATUS FOR PRODUCING CYLINDRICAL FILTERS

[75] Inventors: Albert E. Spaller, Jr., Johnson City; Jack S. Moore, Jr., Blountville, both of Tenn.

[73] Assignee: Eastman Kodak Company, Rochester, N.Y.

[21] Appl. No.: 275,835

[22] Filed: Nov. 25, 1988

[51] Int. Cl.[4] ..... B31C 13/00

[52] U.S. Cl. ..... 493/42; 493/43; 493/45; 493/297; 493/299; 493/300; 493/302; 57/336; 156/441; 156/180

[58] Field of Search ..... 493/41, 42, 43, 45, 493/46, 47, 297, 299, 301, 302, 271, 300, 338, 339; 156/180, 181, 195, 441; 57/6, 336

[56] References Cited

U.S. PATENT DOCUMENTS

| | | | |
|---|---|---|---|
| 2,999,503 | 9/1961 | Schur | 493/42 |
| 3,470,051 | 9/1969 | Meyer | 156/180 |
| 3,538,817 | 11/1970 | Brown | 493/297 |
| 4,395,869 | 8/1983 | Priaroggia | 57/6 |
| 4,429,524 | 2/1984 | Kress | 57/336 |

*Primary Examiner*—Frederick R. Schmidt
*Assistant Examiner*—Jack W. Lavinder
*Attorney, Agent, or Firm*—John F. Stevens; William P. Heath, Jr.

[57] ABSTRACT

Tows of fibers are wrapped around a mandrel or a central fiber core to form a cylindrical filter. At least one belt is located in position to make essentially linear contact with the cylindrical filter, and the at least one belt is driven so as to draw the tows of fiber onto and wrap the mandrel or the central fiber core and so as to move the cylindrical filter axially relative to the mandrel or with the central fiber core.

14 Claims, 7 Drawing Sheets

APPARATUS FOR PRODUCING CYLINDRICAL FILTERS

FIELD OF THE INVENTION

This invention relates to apparatus for producing filters. In particular, it relates to such apparatus in which tows of fibers are wrapped around mandrels or a central fiber core to form a cylindrical filter. It is particularly, but not exclusively, adapted to make cigarette filters.

BACKGROUND OF THE INVENTION

The invention is an off shoot of known technology for making paper tubes from ribbons of flat feed stocks. A basic apparatus for making such paper tubes is disclosed in U.S. Pat. No. 3,538,817, issued Nov. 10, 1970 to Erik Brown, the disclosure of which is hereby incorporated herein by reference. Additionally, FIG. 1 of this application is based on FIG. 1 of that patent. It shows apparatus in which flat paper feedstocks 13, 14, 15, 16 are wrapped around a mandrel 11 rotatably supported in (but not rotatably driven by) a support 12. The tube 43 formed from the feedstocks 13, 14, 15, 16 is advanced relative to the mandrel 11 by the action of an upstream drive belt 34 and a downstream drive belt 40, each of which is wrapped around (and is in surface engagement with) the tube 43. The completed tube 43 (i.e., the tube downstream of the downstream drive belt 40) is cut into lengths by a saw 44.

OBJECTS OF THE INVENTION

It is the Principal object of the invention, very generally speaking, to adapt the technology represented by the Brown patent to the Production of filters from tows of fibers.

It is an additional object to the invention to provide an improved apparatus for producing filters, such as cigarette filters, composed of a plurality of wraps of fibers having different properties and characteristics.

SUMMARY OF THE INVENTION

Tows of fibers are wrapped around a mandrel or a central fiber core to form a cylindrical filter. At least one belt is located in position to make essentially linear contact with the cylindrical filter, and the at least one belt is driven so as to draw the tows of fiber onto the mandrel or the central fiber core and so as to move the cylindrical filter axially relative to the mandrel or with the central fiber core.

DETAILED DESCRIPTION OF THE PRESENTLY PREFERRED EMBODIMENTS

Figure 1:
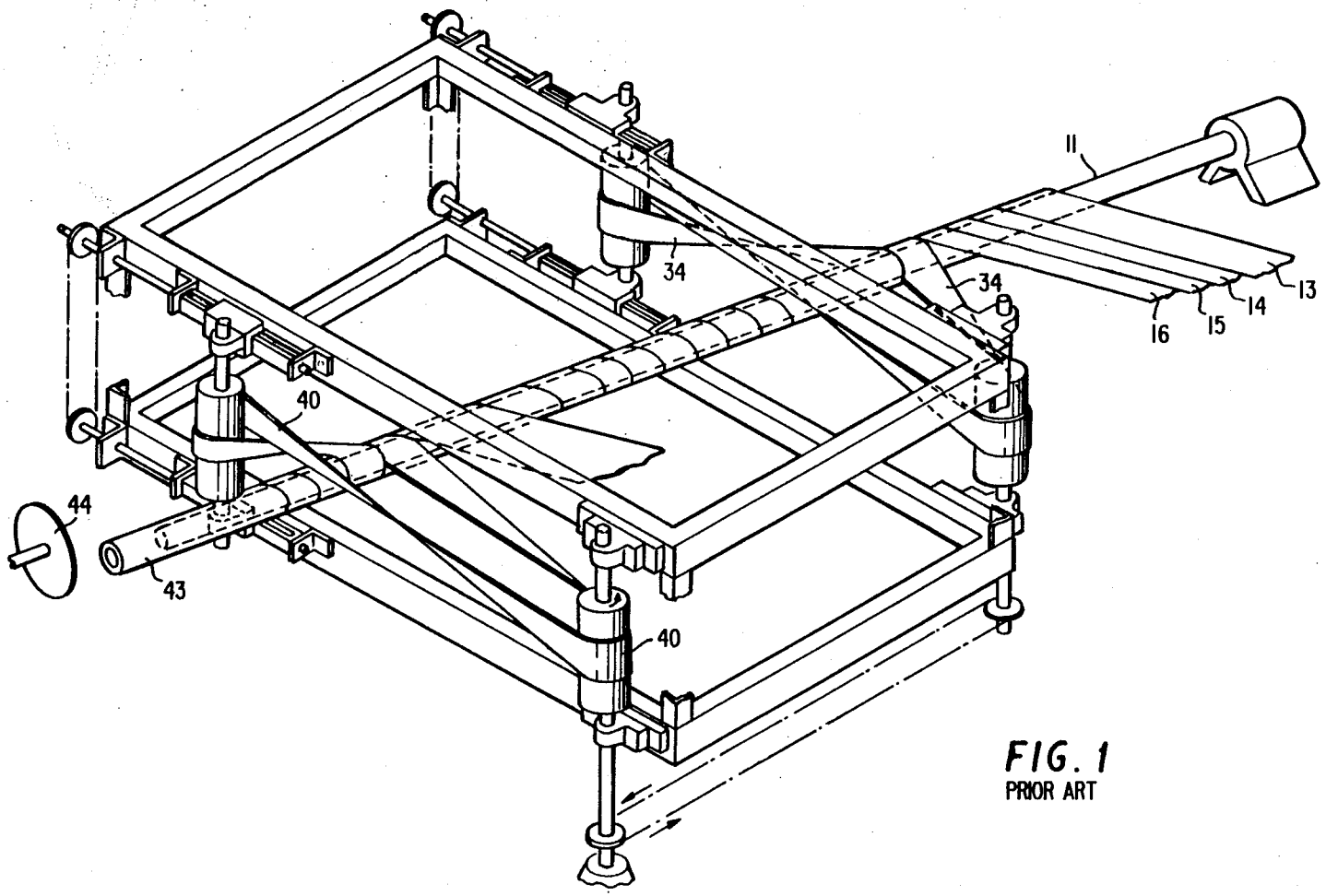
FIG. 1 PRIOR ART
FIG. 1 is a perspective view of a prior art apparatus for making paper tubes from ribbons of flat feedstocks.
Figure 2A:
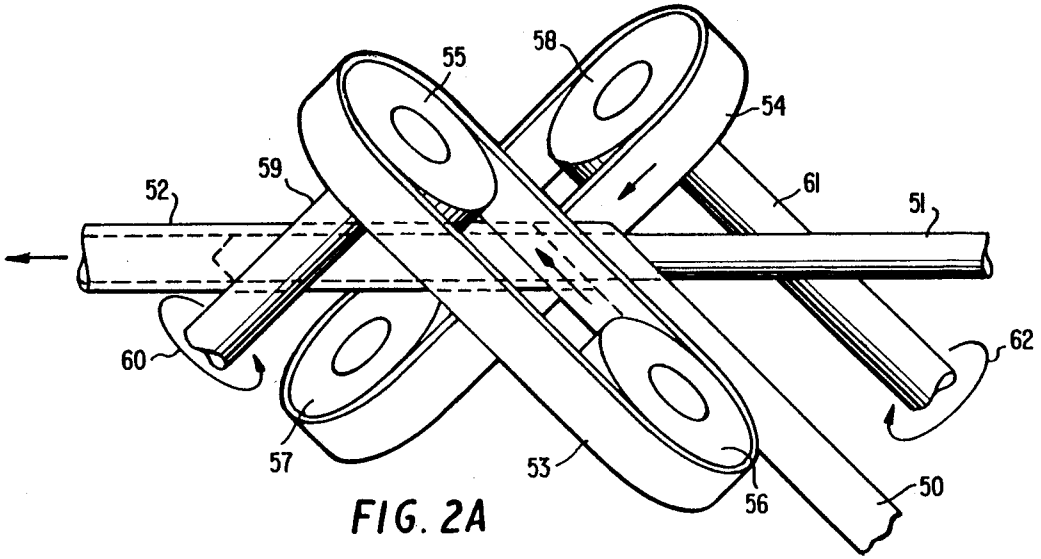
FIG. 2A is a perspective view of key components of an apparatus according to the invention for making cylindrical filters from tows of fibers.

FIG. 2A shows key components of an apparatus according to the invention for making cylindrical filters from a plurality of tows of fibers. However, for simplicity of illustration, only a single tow 50 is shown being wrapped around a mandrel 51. Preferably (but not necessarily), the mandrel 51 is mounted for rotation (e.g., by means like those shown in FIG. 1). The tow 50 is drawn onto the mandrel 51 so as to form a tube 52 centered on the mandrel 51 and advanced relative to the mandrel 51 by a pair of belts 53, 54, each of which makes essentially linear contact with the tube 52. Additionally, the belts 53, 54 aid in sizing the tube 52—that is, the spacing between the belts 53, 54 influences the outer diameter of the tube 52.

The belt 53 is trained on a pair of pulleys 55, 56, and the belt 54 is trained on a pair of pulleys 57, 58. The pulley 55 is mounted on a shaft 59 driven in rotation by means not shown in the direction indicated by an arrow 60. Similarly, the pulley 58 is mounted on a shaft 61 driven in rotation by means not shown in the direction indicated by an arrow 61. Preferably, the belts 53, 54 can be moved towards and away from the mandrel 51 by means not shown in order to optimize the gripping action of the working runs of the belts 53, 54 on the tube 52 and/or to vary the outer diameter of the tube 52.

Figure 2C:
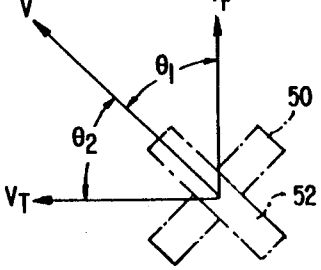
FIG. 2C is a force diagram illustrating the forces applied to a tow of fibers by the other belt in the apparatus shown in FIG. 2A.
Figure 2B:
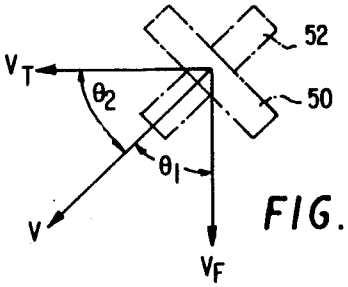
FIG. 2B is a force diagram illustrating the forces applied to a tow of fibers by one belt in the apparatus shown in FIG. 2A.

FIGS. 2B and 2C illustrate the forces applied to the tube 52 by the belts 53, 54. The vector V represents the force applied by each belt 53, 54; the vector $V_T$ represents the twist component of that force; the vector $V_F$ represents the feed component of that force; $\theta_1$ represents the angle between the vector V and the $V_F$; and $\theta_2$ represents the angle between the vector V and the vector $V_T$. In normal use, $\theta_1=\theta_2$, and hence $V_F=V_T$.

Figure 3:
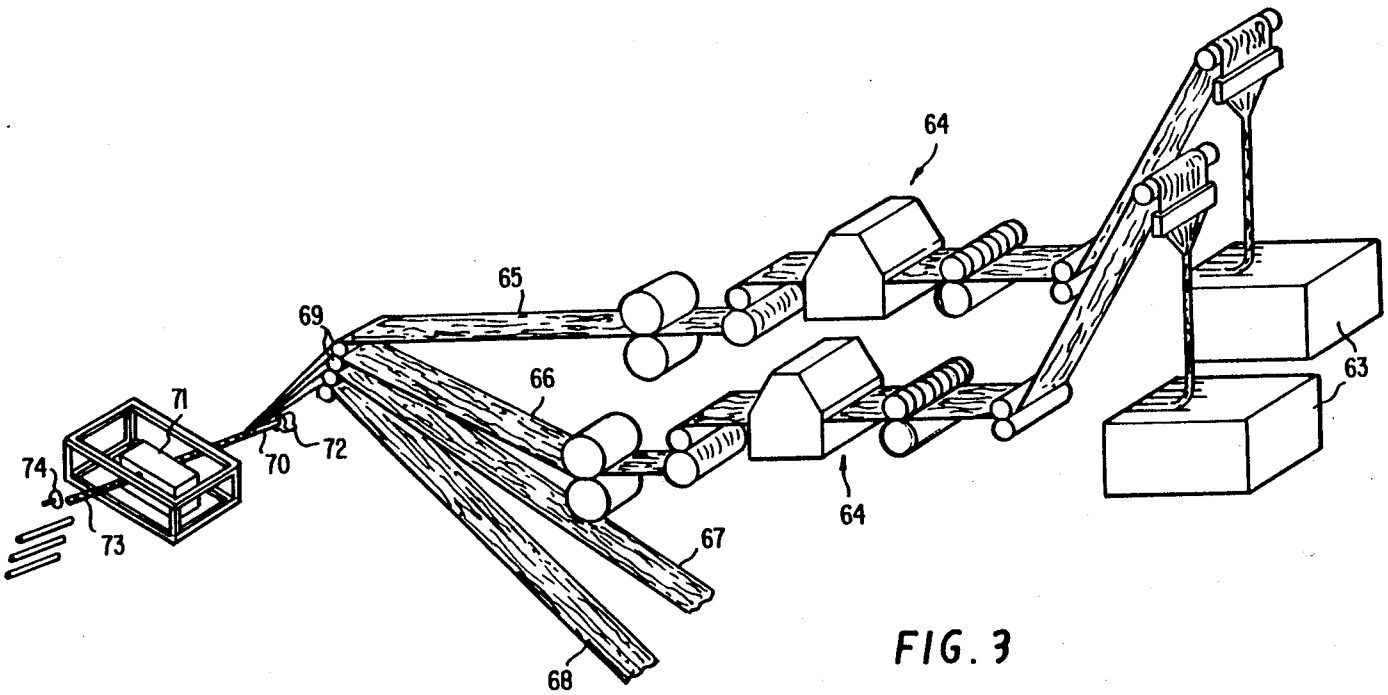
FIG. 3 is a perspective view of apparatus according to the invention for making cylindrical filters from tows of fibers.
Figure 5:
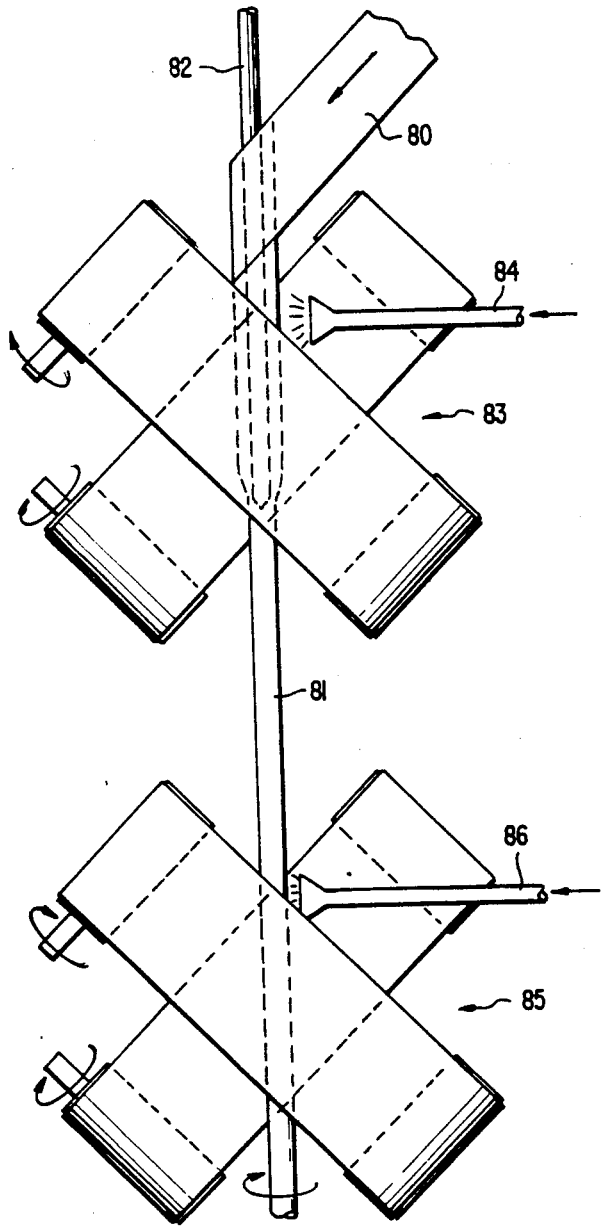
FIG. 5 is a schematic diagram of a first embodiment of apparatus according to the invention for making cylindrical filters in the shapes of solid rods.
Figure 6:
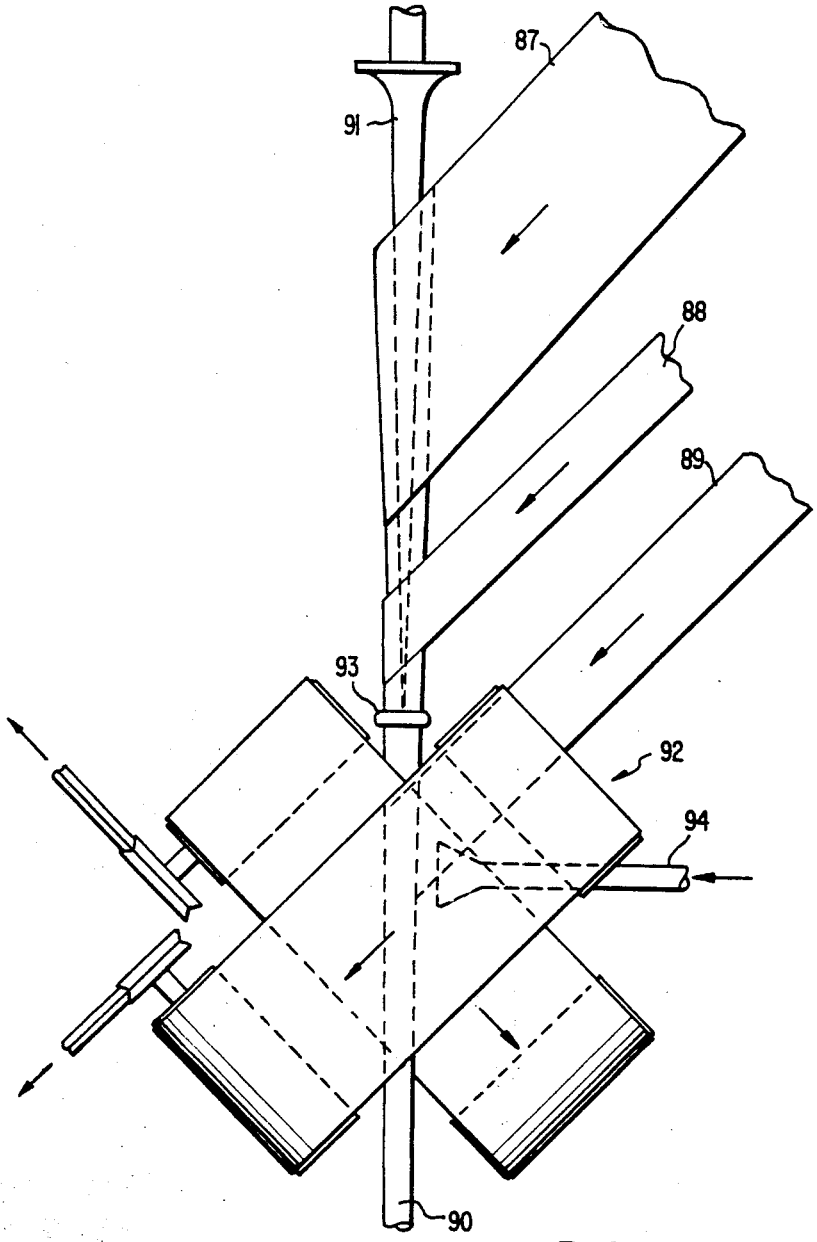
FIG. 6 is a schematic diagram of a second embodiment of apparatus according to the invention for making cylindrical filters in the shapes of solid rods.
Figure 7:
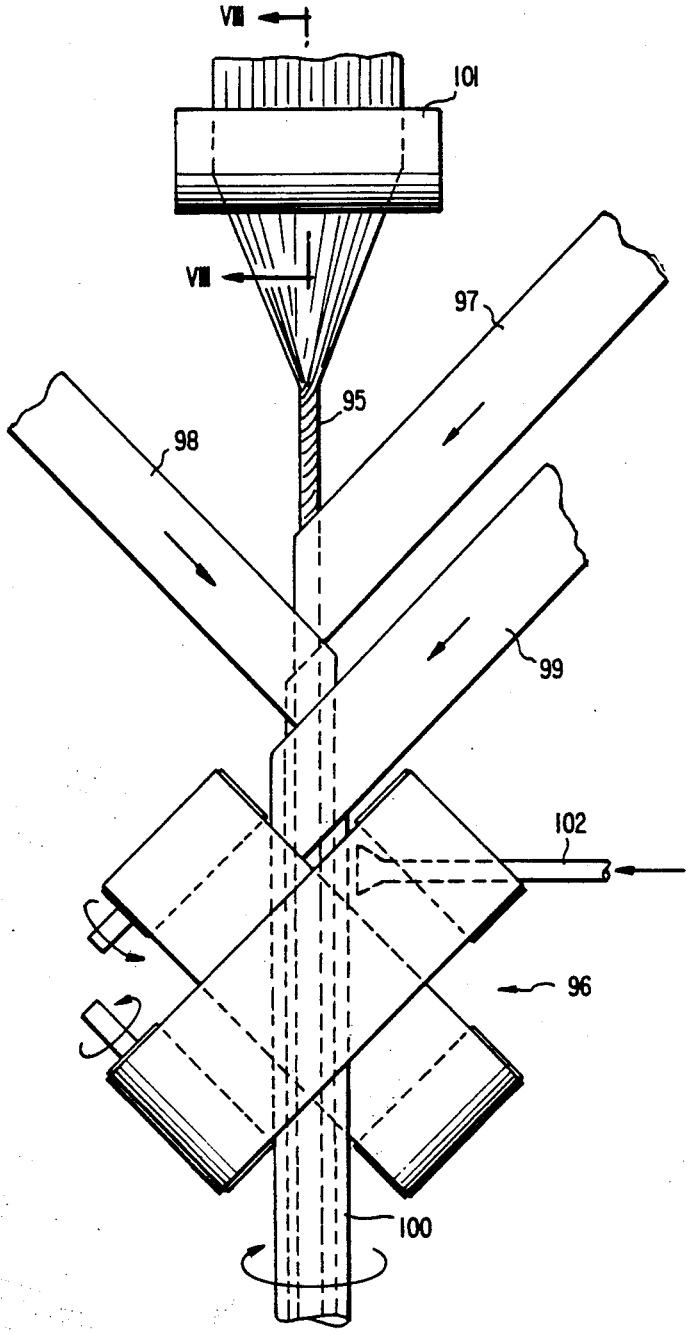
FIG. 7 is a schematic diagram of a third embodiment of apparatus according to the invention for making cylindrical filters in the shapes of solid rods.

FIG. 3 is a perspective view of apparatus according to the invention for making cylindrical filters from tows of fibers. This apparatus comprises a plurality of tow bales 63 at least some of which contain, in use, fibers having different properties and characteristics. For instance, the fibers can vary in color, density, filament size, compactness, additives, etc. The contents of the tow bales 63 can be arranged so that the layers in the cylindrical filters vary in filter density so as to provide coarse filters on the outer layers and progressively finer filter layers toward the axis. Additionally, a solvent glue or a low melting adhesive can be incorporated into the fibers so that the layers of fibers can be set and fixed together by steam, hot air, etc. (as illustrated in FIGS. 5–7).

The fibers from the tow bales 63 are passed through tow processing apparatuses 64 to form tows 65, 66, 67, 68. Since many varieties of tow processing apparatuses are available commercially, and since the particular type of tow processing apparatus used is of no importance to the invention, the tow processing apparatus 64 will not be further described.

The tows 65, 66, 67, 68 pass around tow guides 69 and are drawn onto a mandrel 70 by the action of a belt-drive apparatus 71 of the type shown in FIG. 2A. The mandrel 70 is preferably (but not necessarily) rotatably supported in (but not rotatably driven by) a support 72. The tows 65, 66, 67, 68 form a tube 73. The tube 73 is advanced relative to the mandrel 70 by the action of the belt-drive apparatus 71. Finally, the portion of the tube 73 downstream of the mandrel 70 is cut into lengths by a saw 74.

Figure 4:
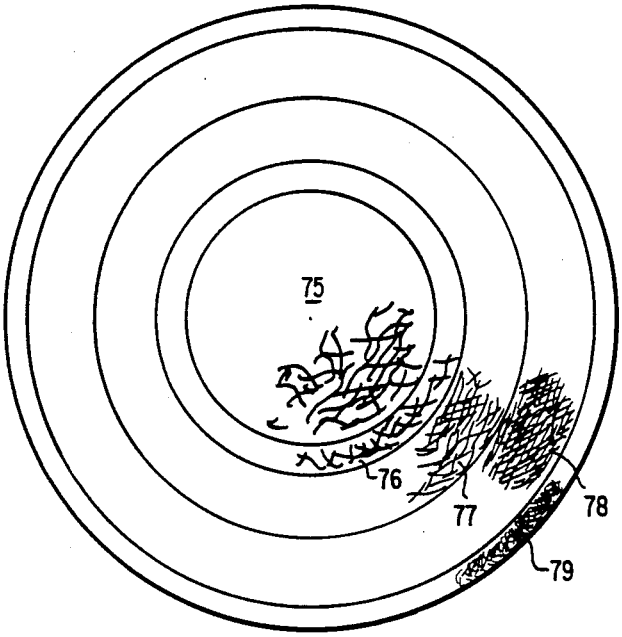
FIG. 4 is a cross sectional view of a cylindrical filter made by an apparatus according to the invention.

FIG. 4 is a cross sectional view of an exemplary cylindrical filter composed of a plurality of wraps of fibers having different properties and characteristics and made by an apparatus according to the invention. (Such filters are, per se, old, but previously they have been made by different apparatuses.) The filter comprises a central core 75 having a pore diameter of from 5 microinches to 25 microinches; a constant pore diameter section 76 in which the pores have diameters of 25 microinches to 60 microinches; a first pre-filter section 77 in which the pores have diameters of approximately 320 microinches; a second pre-filter section 78 in which the pores have diameters of from 5 microinches to 15 microinches; and an outermost pre-filter section 79 in which the pores have diameters of from 25 microinches to 60 microinches.

FIG. 5 is a schematic diagram of a first embodiment of apparatus according to the invention which is particularly adapted to produce solid cylindrical filter rods. In this figure, only a single tow 80 is shown for simplicity of illustration, but it will be understood that, in use, a plurality of tows will normally be used to form a tube 81 wrapped around a mandrel 82. The tube 81 is drawn onto the mandrel 82 and advanced relative to the mandrel 82 by a first belt-drive apparatus 83 of the type shown in FIG. 2A. At the same time, adhesive or glue in the fibers is heated by hot air or steam from a first heat pipe 84. Then, downstream of the mandrel 82, a second belt-drive apparatus 85 of the type shown in FIG. 2A (preferably, but not necessarily, driven approximately 5% faster than the first belt-drive apparatus) provides sufficient additional twist to collapse and close the hole in the tube 81 formed by the mandrel 82, producing a solid cylindrical filter rod. At the same time, the adhesive or glue in the fiber is further heated by hot air or steam from a second heat pipe 86.

FIG. 6 is a schematic diagram of a second embodiment of apparatus according to the invention which is particularly adapted to produce solid cylindrical filter rods. In this figure, three tows 87, 88, 89 form a tube 90 around a mandrel 91. The tube 90 is drawn onto the mandrel 91 and advanced relative to the mandrel 91 by a belt-drive apparatus 92 of the type shown in FIG. 2A except that it is located downstream of the mandrel 91 and downstream of an eyelet guide 93 that collapses and closes the hole in the tube 90 formed by the mandrel 91, producing a solid cylindrical filter rod. At the same time, the adhesive or glue in the fibers is heated by hot air or steam from a heat pipe 94.

Figure 8:
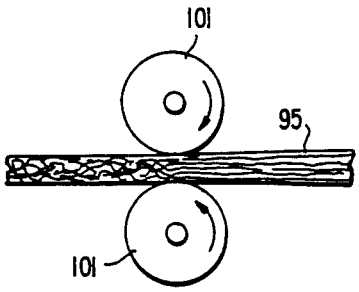
FIG. 8 is a view on the line VIII—VIII in FIG. 7.

FIGS. 7 and 8 are schematic diagrams of a third embodiment of apparatus according to the invention which is particularly adapted to produce solid cylindrical filter rods. In these figures, a central fiber core 95 is produced by a belt-drive apparatus 96 of the tyPe shown in FIG. 2A acting through three tows 97, 98, 99. The three tows 97, 98, 99 are drawn onto the central fiber core 95 by the action of the belt-drive apparatus 96 to form a tube 100, and the tube 100 is advanced axially by the belt-drive apparatus 96. Two (preferably unpowered) rolls 101 prevent the twisting of the central fiber core 95 from moving upstream past the nip between the rolls 101. As with the previous embodiments, the adhesive or glue in the fibers is heated by hot air or steam from a heat pipe 102.

The preferred form of fiber tow is an acetate tow, particularly if the filters being produced are to be used as cigarette filters. However, the invention is limited neither to acetate tows nor to cigarette filters. In particular, apparatuses according to the invention can be used to produce hollow tubular cylindrical filters in which the material to be filtered flows through the filter perpendicularly to the axis of the cylindrical filter, hollow tubular cylindrical filters in which the material to be filtered flows through the filter parallel to the axis of the cylindrical filter, and solid cylindrical filters in which the material to be filtered flows through the filter parallel to the axis of the cylindrical filter.

Obviously, numerous modifications and variations of the present invention are possible in light of the above teachings. It is, therefore, to be understood that, within the scope of the appended claims, the invention may be practiced otherwise than as specifically described herein.

We claim:

1. Apparatus for making cylindrical filters from tows of fibers, said apparatus comprising:

(a) a mandrel;

(b) at least one first belt located adjacent to said mandrel and in position to make essentially linear contact with a tube formed from at least one tow of fibers twisted around said mandrel;

(c) first means for driving said at least one first belt so as to draw said at least one tow of fibers onto said mandrel and so as to move the tube axially relative to said mandrel;

(d) at least one second belt located downstream of said mandrel in position to contact the tube and (e) second means for driving said at least one second belt so as to collapse the tube and close the hole in the tube formed by said mandrel.

2. Apparatus as recited in claim 1 wherein said second means drives said at least one second belt faster than said first means drives said at least one first belt.

3. Apparatus as recited in claim 2 wherein said second means drives said at least one second belt at least approximately 5% faster than said first means drives said at least one first belt.

4. Apparatus as recited in claim 1 comprising two second belts located downstream of said mandrel in position to make essentially linear contact with the tube.

5. Apparatus as recited in claim 4 wherein said two second belts are located on opposite sides of said mandrel in position to contact diametrically opposite portions of the tube.

6. Apparatus as recited in claim 1 wherein said second means comprise:

(a) at least two second pulleys about which said at least one second belt is trained and (b) a second shaft on which one of said at least two second pulleys is mounted.

7. Apparatus for making cylindrical filters from tows of fibers, said apparatus comprising:

(a) a mandrel;

(b) at least one first belt located adjacent to and downstream of said mandrel and in position to make essentially linear contact with a tube formed from at least one tow of fibers twisted around said mandrel;

(c) first means for driving said at least one first belt so as to draw said at least one tow of fibers onto said mandrel and so as to move the tube axially relative to said mandrel;

(d) at least one second belt located downstream of said mandrel in position to contact the tube;

(e) second means for driving said at least one second belt so as to collapse the tube and close the hole in the tube formed by said mandrel; and (f) an eyelet guide located between said mandrel and said at least one first belt and sized, shaped, and positioned to collapse the tube and close the hole in the tube formed by said mandrel.

8. Apparatus for making cylindrical filters from tows of fibers, said apparatus comprising:

(a) a plurality of tow bales at least some of which contain, in use, fibers having different properties and characteristics;

(b) a plurality of tow-processing apparatuses, each one of said plurality of tow processing apparatuses being associated with one of said plurality of tow bales so as to make a tow of fibers from fibers contained in the associated one of said plurality of tow bales;

(c) a mandrel;

(d) at least one first belt located adjacent to said mandrel and in position to make essentially linear contact with a tube formed from at least one tow of fiber wrapped around said mandrel;

(e) first means for driving said at least one first belt so as to draw said at least one tow of fibers onto said mandrel and so as to move the tube axially relative to said mandrel;

(f) at least one second belt located downstream of said mandrel in position to make essentially linear contact with the tube and (g) second means for driving said at least one second belt so as to collapse the tube and close the hole in the tube formed by said mandrel.

9. Apparatus as recited in claim 8 wherein said second means drives said at least one second belt faster than said first means drives said at least one first belt.

10. Apparatus as recited in claim 9 wherein said second means drives said at least one second belt at least approximately 5% faster than said first means drives said at least one first belt.

11. Apparatus as recited in claim 8 comprising two second belts located downstream of said mandrel in position to make essentially linear contact with the tube.

12. Apparatus as recited in claim 11 wherein said two second belts are located on opposite sides of said mandrel in position to contact diametrically opposite portions of the tube.

13. Apparatus as recited in claim 8 wherein said second means comprise:

(a) at least two second pulleys about which said at least one second belt is trained and (b) a second shaft on which one of said at least two second pulleys is mounted.

14. Apparatus for making cylindrical filters from tows of fibers, said apparatus comprising:

(a) a plurality of tow bales at least some of which contain, in use, fibers having different properties and characteristics;

(b) a plurality of tow-processing apparatuses, each one of said plurality of tow processing apparatuses being associated with one of said plurality of tow bales so as to make a tow of fibers from fibers contained in the associated one of said plurality of tow bales;

(c) a mandrel;

(d) at least one first belt located adjacent to said mandrel and in position to make essentially linear contact with a tube formed from at least one tow of fiber wrapped around said mandrel;

(e) first means for driving said at least one first belt so as to draw said at least one tow of fibers onto said mandrel and so as to move the tube axially relative to said mandrel;

(f) at least one second belt located downstream of said mandrel in position to make essentially linear contact with the tube;

(g) second means for driving said at least one second belt so as to collapse the tube and close the hole in the tube formed by said mandrel; and (h) an eyelet guide located between said mandrel and said at least one first belt and sized, shaped, and positioned to collapse the tube and close the hole in the tube formed by said mandrel.

* * * * *